United States Patent [19]

Hara et al.

[11] Patent Number: 4,538,667

[45] Date of Patent: Sep. 3, 1985

[54] MOLDS FOR CONTINUOUSLY CASTING STEEL

[75] Inventors: Senri Hara, Ibaragi; Hiroshi Tomono, Osaka; Tomohiko Kimura, Fukuoka; Kunio Inoue, Takarazuka; Takayuki Sato, Osaka; Yoshio Okada, Takarazuka, all of Japan

[73] Assignees: Sumitomo Metal Industries, Ltd.; Satosen Co., Ltd., both of Osaka, Japan

[21] Appl. No.: 648,606

[22] Filed: Sep. 7, 1984

Related U.S. Application Data

[63] Continuation of Ser. No. 372,295, Apr. 27, 1984, abandoned.

[30] Foreign Application Priority Data

Apr. 27, 1981 [JP] Japan ..... 56-64557
Aug. 3, 1981 [JP] Japan ..... 56-122202

[51] Int. Cl.[3] ..... B22D 11/00

[52] U.S. Cl. ..... 164/418; 164/149; 164/268; 164/472

[58] Field of Search ..... 164/138, 149, 268, 418, 164/472; 249/135

[56] References Cited

U.S. PATENT DOCUMENTS 4,027,716 6/1977 Theobald et al. ..... 164/138
4,037,646 7/1977 Hara et al. ..... 164/138

FOREIGN PATENT DOCUMENTS 55-70453 5/1980 Japan ..... 164/418

*Primary Examiner*—Nicholas P. Godici
*Assistant Examiner*—R. Seidel
*Attorney, Agent, or Firm*—Armstrong, Nikaido, Marmelstein & Kubovcik

[57] ABSTRACT

A mold of copper or copper alloy for continuously casting steel comprises a rough inner surface, a plating of nickel, cobalt or alloy thereof formed over the inner surface and a chromium plating formed over said plating. The mold has a prolonged mold life, gives steel slabs with improved qualities and reduces amounts of lubricating material used in the molding operation.

20 Claims, No Drawings

MOLDS FOR CONTINUOUSLY CASTING STEEL

This application is a continuation of application Ser. No. 372,295, filed Apr. 27, 1984, now abandoned.

This invention relates to molds for continuously casting steels such as low-carbon steels, medium-carbon steels, high-carbon steels, stainless steels, alloy steels of special grades and the like.

The mold for continuously casting steel slabs comprises a pair of opposed rectangular plates dimensionally identical with each other and each having a lengthwise long side for defining the thickness of the slab and a pair of opposed oblong plates dimensionally identical with each other and each having a vertically long side for defining the width of the slab. Conventionally plates forming the mold are made of copper or copper alloy with high thermal conductivity and have a plating or like protective coating formed over the inner surface of the plates (hereinafter referred to as "base surface"). In casting operation, a vitreous powder or like lubricating or friction-reducing material is placed between the coated inner mold surface (hereinafter referred to as "coated surface") and molten steel, to reduce the friction between molten steel or steel slabs and the coated surface. In this case, the powder melts upon receipt of heat from the molten steel, thereby serving as the lubricant.

We conducted extensive research to mitigate difficulties frequently posed by conventional molds for continuous casting such as: the reduction of mold life which is attributable to the damage to a portion of the coated surface brought into contact with molten steel being poured; the breakout resulting from the adhesion of molten steel droplets to the coated surface; etc. Our research matured to numerous inventions. However, it is now desired to provide molds for continuous casting with more improved properties and performance because molds have been recently used under more severe casting conditions such as higher casting rates with the progress in the technique of continuous casting.

The object of this invention is to provide molds for continuously casting steel which have enhanced properties and performance and thus a prolonged mold life.

Other objects and features of this invention will become more apparent from the following description.

This invention provides molds of copper or copper alloy for continuously casting steel comprising a rough base surface, a plating of nickel, cobalt or alloy thereof formed over the base surface and a chromium plating formed over the foregoing plating.

Our research shows that the foregoing object is accomplished by forming specific plating layers over a rough base surface in contrast to the concept known in the art. The conventional concept has been that the coated surface should be as smooth as possible, although subject to economy, to achieve the lowest friction between molten steel or steel slabs and coated surface and to provide steel slabs with the smoothest surface. In other words, it has been thought that the smoother the coated surface, the longer the mold life and the better the surface of steel slabs. Heretofore there have been used even molds which have the base surface and coated surface mirror-finished. However, our research reveals that the following problems arise from the molds having an extremely smooth surface. (i) When the coated surface has a high smoothness, the lubricant is easily moved upon contact with moving steel slabs, and thus unevenly distributed over the coated surface. In the extreme cases, little or no lubricant material is present between molten steel and the coated surface over some parts of the surface. These parts are abraded by steel slab, thereby increasing the friction between abraded parts and slab and the resistance against the withdrawal of slab. As a result, a thin outer layer of solidified steel is broken so that there occurs breakout. (ii) Uneven distribution of lubricating material results in the presence of excess lubricant on some parts of the coated surface. In such parts, there arises insufficient cooling of molten steel and slab from the low thermal conductivity of the lubricant. Thereby an extremely thin film of solidified steel is formed, which is liable to lead to breakout. This phenomenon is likely to occur when a large amount of lubricant is used in an attempt to spread it over the entire coated surface. (iii) Large amounts of lubricating material tend to be present in the corner portions of casting mold. The excess lubricant in corners is likely to produce breakout therein and to delay the formation of solidified surface layer in the corners of slab which tends to create star cracks. (iv) Since the lubricant is easily discharged from the mold together with the slab being withdrawn, a new supply of lubricant must be frequently placed in the mold, consequently necessitating cumbersome operations and large amounts of lubricant, hence economically unfavorable. (v) When at least two protective platings are formed over the base surface, the difference in elongation between the metal materials is apt to produce large stress and strain in the outermost plating, thereby forming cracks therein. The formation of cracks reduces the mold life and impairs the quality of slabs.

From the conventional viewpoint, it may be assumed that the surface of steel slabs would be deteriorated when using the molds of this invention with an uneven coated surface. Unexpectedly, however, the present molds are found to be able to cast steel slabs with the quality comparable with or even superior to that of the slabs given by conventional molds. With the present molds, the lubricant is retained uniformly in the fine valleys of the uneven surface. This retention substantially precludes any breakout or cracks at corners from occurring due to the shortage or excess of lubricant. Since the lubricating material initially supplied are mostly left and maintained in the fine valleys of the non-flat surface, the frequency of supplying the lubricating material and the total amount of the lubricant needed are sharply reduced. Further according to this invention, virtually no crack is produced over the alloy plating, its oxidized layer or chromium plating formed as the topcoat so that the mold life is extended and steel slabs are cast with enhanced quality. More specifically stated, the formation of cracks in the plating layer is prevented because the difference between the base surface and the plating layer formed over the base surface or between the respective layers in thermal stress and strain is moderated by the enlarged surface area resulting from the uneveness of the surface.

The mold of this invention is similar in the basic structure to conventional molds of copper or copper alloy for continuously casting steel. The present mold has a surface roughness of about 20 to about 200S, preferably about 50 to about 150S, according to Japanese Industrial Standards B0601. With a surface roughness of less than 20S, it is difficult to provide improved lubricity as desired and to prevent formation of crack in the outermost plating to a satisfactory extent. The uneven surface having a surface roughness of over 200S is unfavorable because casting operations markedly wear out crests of the ridges of the irregular surface. The desired uneven surface may be such that infinitesimal ridges and valleys are regularly distributed when viewed microscopically and macroscopically or that they are almost uniformly distributed from a microscopic view although irregularly distributed from a macroscopic view. Also desirable are wavelike arrangements comprising series of ridges and valleys running in parallel. With wavelike arrangements, it is more preferred to align the series of ridges and valleys in the direction of flow of molten steel being poured, although the direction of the alignment is not particularly limited. The non-flat surface can be produced by any suitable method such as shot blasting, mechanical machining by a shaper or the like, a method comprising forming partly masked minute portions and selectively etching unmasked portions over the base surface, a method comprising moving over the base surface a roll having small protrusions or minute wavelike pattern to press the base surface, etc. Usually plating layers to be described below are formed over the rough surface thus formed. Further, with new molds of copper or copper alloy, it is possible to perform the treatment for giving an irregular surface after forming a single plating layer, two plating layers or three plating layers directly over the base surface.

According to this invention, one of the platings (a) to (d) to be described below is formed over the base surface. (a) A first layer of nickel, cobalt or alloy thereof is formed by electroplating over the base surface and a second layer of chromium is applied over the first layer. Although variable depending on the kind of steel material, dimensions of the mold, etc., the preferred thickness of the nickel and/or cobalt plating is about 195 to about 2950 μm and that of the chromium plating about 5 to about 50 μm, hence the desired total thickness being about 200 to about 3000 μm. More preferred are a first layer about 300 to about 1000 μm thick and a second layer about 10 to about 20 μm thick, these layers having a total thickness of about 310 to about 1020 μm. When the nickel and/or cobalt plating is over 2950 μm thick, cracks are prone to occur at a level in the interior of the mold at which the coated surface is in contact with the meniscus of molten steel placed in the mold. In this case, large cracks run deep sometimes into 2.5 times the thickness of the platings, namely into the copper material portion of the mold. With a thickness of less than 195 μm, the first layer is low in abrasion resistance so that part of the copper material is likely to be exposed particularly at the lower portion of the coated surface in an early stage of continuous casting operation. The chromium plating layer over 50 μm thick tends to produce cracks locally which contribute to the separation of the layer and likely reach the nickel and/or cobalt layer, even when the surface is so uneven as to be able to distribute and moderate the thermal stress of the topcoat. The second layer less than 5 μm thick is apt to become poor locally in adhesion to the first layer or to produce pinholes or the like, consequently failing to achieve the desired effect, hence undesirable. The term nickel used herein includes nickel materials containing about 0.2 to about 3% of cobalt as impurities. (b) Over the base surface is applied a first layer of nickel, cobalt or alloy thereof over which is formed a second layer of an alloy comprising 3 to 20% by weight of phosphorus and/or 2 to 15% by weight of boron, and nickel and/or cobalt as the balance. When containing phosphorus and/or boron in lesser amounts, the second layer is prone to have lower heat resistance and hardness. But the use thereof in larger amounts leads to economical disadvantage. The second alloy plating, although applicable by electrodeposition, is preferably formed by an electroless plating procedure because the procedure usually produces fine crystals and easily affords a plating of uniform thickness whether over the planar or curved base surface or over the base surface of a mold in the form of a quadrilaterally fabricated tube or a cylinder. The thicknesses of the first layer and the second layer, although variable with the casting temperature, kind of steel, dimensions of the mold, etc. are usually about 30 to about 1900 μm and about 10 to 100 μm, respectively, the desired total thickness being about 40 to 2000 μm, and more preferably about 100 to about 1000 μm and about 20 to about 60 μm, respectively, the combined thickness being about 120 to about 1060 μm. The first layer is interposed between the copper material and the second layer different in the properties from the copper and can support the second layer against thermal, mechanical and other various loads and serve as a buffering layer to permit the second layer to satisfactorily function. The first layer with less than 30 μm thickness fails to meet the requirements. The first layer more than 1900 μm thick likely produces cracks upon receipt of high heat and to lead to insufficient cooling of the mold in high-speed casting operation. The second layer less than 10 μm thick is low in abrasion resistance, while the one over 100 μm thick likely creates cracks and causes damage to the mold because of insufficient cooling of the mold resulting from the low thermal conductivity of the alloy of the second layer. (c) A third layer of chromium plating formed over the second layer stated above in (b) can provide prolonged mold life. The chromium plating can be applied by the usual electroplating. The chromium plating is extremely effective in preventing the adhesion of splash of molten steel which otherwise would occur on initial influx of molten steel. The third layer is usually about 5 to about 100 μm thick, preferably about 10 to about 30 μm thick. (d) An oxidized layer is formed by oxidizing the surface of the second layer described above in (b). This layer is also markedly effective in precluding the adhesion of splash of molten steel taking place on initial influx of molten steel. The oxidatively surfaced layer can be formed by conventional oxidizing methods such as those in which the second layer of the alloy as the anode is oxidized by electrolysis in an aqueous solution of sodium hydroxide or like alkaline material or those in which the surface of the alloy layer is heated in an atmosphere by a gas burner (flame oxidation method). The oxidized layer is at least about 0.001 μm thick, preferably up to about 0.5 μm thick.

The mold of this invention has the feature in the combination of forming an irregular base surface and applying specific protective layers, which can achieve remarkable results: the extension of mold life, improvements in the quality of steel slab and reduction in the amount of a lubricant to be used.

The following examples illustrate this invention in more detail.

EXAMPLE 1

A copper mold (300 mm wide × 1300 mm long × 800 μm high) for continuously casting steel slabs was masked with a vinyl chloride coating composition over a portion of the base surface other than a portion thereof to be brought into contact with molten steel. The mold was degreased by being immersed at 55° C. for 30 minutes in an aqueous solution containing 55 g/l of sodium hydroxide, 30 g/l of sodium carbonate and 5 g/l of an anion surfactant and then was washed with water. Subsequently it was electrolytically degreased in an aqueous solution containing 35 g/l of sodium hydroxide, 160 g/l of sodium orthosilicate and 10 g/l of an anion surfactant and having a temperature of 55° C. at a cathode current density of 10 A/dm$^2$ for 3 minutes. The mold body thus degreased was washed with water and then was activated by being immersed at an ordinary temperature for 15 minutes in a 5% aqueous solution of sulfuric acid. After washing with water, the mold was electroplated by being dipped in a bath containing 450 g/l of nickel sulfamate, 40 g/l of nickel chloride, 20 g/l of boric acid and 3 g/l of sodium naphthalene trisulfonate and having a temperature of 50° C. and a pH of 4.5 at a cathode current density of 1.5 A/dm$^2$ for 30 hours while continuously filtering the bath, whereby a 550 μm-thick nickel plating was formed on the mold body.

Then the mold body was electroplated in a bath containing 320 g/l of anhydrous chromic acid, 0.8 g/l of sulfuric acid and 5 g/l of potassium silicofluoride and having a temperature of 50° C. at a cathode current density of 25 A/dm$^2$ for 40 minutes to form a 10 μm thick chromium plating over the nickel plating.

Five other molds were treated over the base surface in the same manner as above. The molds were tested by continuously casting low-carbon steel slabs at a casting rate of 0.8 m/min to check how the uneven surface of each mold affected the formation of crack and separation of the chromium layer, mold life and appearance of the surface of steel slabs. Table 1 shows the results. Before electroplating, the base surface of the mold had been machined by a shaper to give a specific surface roughness so that the series of infinitesimal ridges and valleys of the irregular surface run in the direction of flow of the molten steel being poured.

TABLE 1

| No. | Surface roughness | Appearance of chromium layer after 100 charges* Crack | Separation | Mold life (number of charges) | Appearance of slab surface (after 100 charges) | Amount of vitreous powder used (kg/t of molten steel) |
|---|---|---|---|---|---|---|
| 1 | Less than 10S | Found | Locally found | 150 | Normal | 0.50 |
| 2 | 25S | None | None | 300 | Good | 0.45 |
| 3 | 70S | None | None | 350 | Excellent | 0.35 |
| 4 | 150S | None | None | 550 | Excellent | 0.35 |
| 5 | 200S | None** | None | 600 | Good | 0.30 |
| 6 | 250S | None | None | 300 | Good | 0.40 |

*Amount of molten steel per charge = 250 t
**Abraded in corners

As apparent from Table 1, the molds of this invention were outstanding in the durability and gave steel slabs with improved quality and markedly reduces the amounts of vitreous lubricating material to be used. The tests show that when using the rough surfaced molds, the amounts of vitreous powder were reduced by about 20 to about 30% compared with the amounts of 0.45 to 0.5 kg/t in conventional molds.

EXAMPLE 2

A roll with a minutely arranged wavelike pattern was moved over the base surface of a copper mold dimensionally identical with the molds used in Example 1 to form a surface roughness of 70S. The same procedure as above was repeated to obtain nine other molds similarly surfaced. Over the base surfaces of the molds were formed first layers having the compositions and thicknesses as indicated in Table 2 and second layers of 20 μm-thick chromium. The molds were used to continuously cast low-carbon steels in the same manner as in Example 1. Table 2 shows the results.

TABLE 2

| | First layer Composition (wt. %) Ni | Co | Thickness (m) | Mold life (number of charges) | Appearance of slab surface (after 200 charges) |
|---|---|---|---|---|---|
| 1 | 85 | 15 | 250 | 280 | Good |
| 2 | 85 | 15 | 1000 | 380 | Excellent |
| 3 | 85 | 15 | 2500 | 450 | Good |
| 4 | 50 | 50 | 200 | 250 | Normal |
| 5 | 50 | 50 | 1500 | 350 | Good |
| 6 | 50 | 50 | 2700 | 410 | Good |
| 7 | 30 | 70 | 500 | 280 | Normal |
| 8 | 30 | 70 | 1000 | 320 | Good |
| 9 | — | 100 | 350 | 150 | Normal |
| 10 | — | 100 | 800 | 180 | Normal |

EXAMPLE 3

(i) Formation of a rough surface

A mold (300 mm wide×1300 mm long×800 mm high) for continuously casting steel slabs was machined by a shaper over a portion of the base surface to be brought into contact with molten steel so that the series of infinitesimal ridges and valleys of the rough surface run in the direction of flow of molten steel being poured.

(ii) Pretreatment

The base surface of the mold was masked with a vinyl chloride coating composition over the portion thereof other than that to be in contact with molten steel. The mold body was degreased by being immersed at 50° C.

for 40 minutes in an aqueous solution containing 50 g/l of sodium hydroxide, 25 g/l of sodium carbonate and 5 g/l of an anion surfactant. The mold was washed with water and was electrolytically degreased in an aqueous solution containing 30 g/l of sodium hydroxide, 150 g/l of sodium orthosilicate and 10 g/l of an anion surfactant and having a temperature of 60° C. at a cathode current density of 10 A/dm$^2$ for 2 minutes. The mold body was then washed again with water and was activated by being dipped in a 5% aqueous solution of sulfuric acid having an ordinary temperature for 10 minutes.

(iii) Formation of a nickel plating

The mold body thus activated was washed with water and was electroplated in a bath containing 500 g/l of nickel sulfamate, 30 g/l of nickel chloride, 10 g/l of boric acid, and 3 g/l of sodium naphthalene trisulfonate and having a temperature of 45° C. and a pH of 4.8 at a cathode current density of 1 A/dm$^2$ for 10 hours while filtering the bath to form a 120 μm-thick nickel plating.

(iv) Formation of an alloy plating

The mold with the nickel plating formed over the base surface was washed with water and was subjected to an electroless plating procedure by being immersed in a bath containing 30 g/l of nickel sulfate, 180 g/l of sodium citrate and 18 g/l of sodium hydrophosphite and having a temperature of 90° C. and a pH of 12 for 8 hours to form a 23 μm-thick plating of nickel-phosphorus alloy containing 88% by weight of nickel and 12% by weight of phosphorus. The mold body was then washed with water and dried. The coating composition was removed from the masked area.

Six other molds were treated in the same manner as above.

The molds were used to continuously casting medium-carbon steel at a casting rate of 0.8 m/min and checked to find how the uneven surface of the mold affected the formation of crack and separation of the alloy plating, mold life and appearance of surface of slabs. Table 3 shows the results.

TABLE 3

| No. | Surface roughness | Appearance of topcoat after 100 charges* Crack | Separation | Mold life (number of charges) | Appearance of slab surface (after 100 charges) |
|---|---|---|---|---|---|
| 1 | Less than 10S | A** | None | 350 | Normal |
| 2 | 20S | A** | None | 400 | Good |
| 3 | 50S | None | None | 400 | Good |
| 4 | 100S | None | None | 550 | Excellent |
| 5 | 150S | None | None | 600 | Excellent |
| 6 | 200S | None | None | 500 | Good |
| 7 | 250S | B*** | None | 400 | Normal |

*Amount of molten steel per charge = 250 t
**The mark "A" in Table 3 (and in other tables given hereinafter) shows that small cracks were formed but caused no trouble to the casting operation.
***The mark "B" in Table 3 (and in other tables appearing later) indicates that there were small cracks and abraded crests of ridges hindering the casting operation.

As seen from Table 3, the molds of this invention are excellent in the durability and give steel slabs with improved quality. Further the molds of this invention with the irregular surfaces reduced the amount of vitreous powder approximately by 20 to 30%, compared with the amounts of 0.45 to 0.5 kg/t in conventional molds.

EXAMPLE 4

The similar copper mold as used in Example 3 was machined by a shaper over the base surface in the same manner as in Example 3 to give a surface roughness of 100S. Nine other molds were treated in the same manner as above. Then over the base surfaces of the molds were formed first layers and then second layers respectively having the compositions and thicknesses as indicated in Table 4 below. The molds thus surfaced were used to continuously cast medium-carbon steels in the same manner as in Example 3. Table 4 shows the results.

TABLE 4

| No. | First layer Composition (wt. %) Ni | Co | Thickness (μm) | Second layer Composition (wt. %) Ni | Co | P | B | Thickness (μm) | Mold life (number of charges) | Appearance of slab surface (after 200 charges) |
|---|---|---|---|---|---|---|---|---|---|---|
| 1 | 100 | — | 500 | 95 | — | 5 | — | 60 | 900 | Good |
| 2 | 100 | — | 500 | 86 | — | 14 | — | 30 | 500 | Good |
| 3 | 100 | — | 1000 | 96 | — | — | 4 | 30 | 800 | Good |
| 4 | — | 100 | 500 | — | 95 | 5 | — | 30 | 500 | Normal |
| 5 | — | 100 | 500 | — | 91 | 9 | — | 30 | 500 | Normal |
| 6 | — | 100 | 500 | — | 97 | — | 3 | 20 | 450 | Normal |
| 7 | 60 | 40 | 500 | 80 | 12 | 8 | — | 30 | 500 | Normal |
| 8 | 80 | 20 | 500 | 90 | 7 | 3 | — | 30 | 600 | Normal |
| 9 | 80 | 20 | 1000 | 60 | 34 | — | 6 | 30 | 700 | Normal |
| 10 | 80 | 20 | 1000 | 60 | 30 | 6 | 4 | 30 | 700 | Normal |

EXAMPLE 5

(i) Formation of a rough surface

A mold made of copper alloy containing 1% of chromium (200 mm wide × 1300 mm long × 700 mm high) for continuously casting steel was machined in the same manner as in Example 3 to provide a non-flat surface.

(ii) Pretreatment

The same pretreatment as in Example 3 was effected.

(iii) Formation of a cobalt plating

After activation, the mold body was washed with water and was electroplated by being immersed at 70°

C. for 15 hours in a bath containing 260 g/l of cobalt chloride and 30 g/l of boric acid and having a pH of 4.5 at a cathode current density of 1 A/dm$^2$ to form a 170 μm-thick cobalt plating.

(iv) Formation of an alloy plating

The mold with the cobalt plating formed over the base surface was washed with water and was subjected to an electroless plating procedure by being immersed in a bath containing 30 g/l of nickel sulfate, 140 g/l of sodium citrate, 18 g/l of sodium hypophosphite and having a temperature of 90° C. and a pH of 10 for 10 hours to form a 30 μm-thick plating of nickel-phosphorus alloy consisting of 93 wt. % of Ni and 7 wt. % of P.

(v) Formation of a chromium plating

The mold body with the alloy plating formed was washed with water and was electroplated over the alloy plating by being dipped in a bath containing 320 g/l of anhydrous chromic acid, 0.8 g/l of sulfuric acid and 5 g/l of potassium silicofluoride and having a temperature of 50° C. at a cathode current density of 25 A/dm$^2$ for 60 minutes to form a 15 μm-thick chromium plating.

The mold was washed with water and dried. The coating composition was removed from the masked area. Then the mold was used to continuously cast stainless steels at a casting rate of 0.8 m/min.

Six other molds were subjected to the same procedure as above and used for the same casting operation. Table 5 shows the results.

TABLE 5

| No. | Surface roughness | Appearance of topcoat after 100 charges* Crack | Separation | Mold life (number of charges) | Appearance of slab surface (after 100 charges) |
|---|---|---|---|---|---|
| 1 | Less than 10S | A | None | 400 | Normal |
| 2 | 20S | A | None | 500 | Good |
| 3 | 50S | A | None | 500 | Good |
| 4 | 100S | None | None | 600 | Excellent |
| 5 | 150S | None | None | 600 | Excellent |
| 6 | 200S | None | None | 600 | Good |
| 7 | 250S | B | None | 500 | Normal |

*Amount of molten steel per charge = 250 t

The molds used in this example were found remarkable in the durability and gave steel slabs with improved quality. The amounts of the vitreous powder used were reduced by 20 to 30% compared with the amounts in conventional molds.

(ii) Pretreatment

The same procedure of Example 3 was repeated.

(iii) Formation of a nickel-cobalt plating

After the activation, the mold body was washed with water and was electroplated by being immersed in a bath containing 300 g/l of cobalt chloride, 40 g/l of nickel chloride and 20 g/l of boric acid and having a temperature of 70° C. and a pH of 4.5 at a cathode current density of 1 A/dm$^2$ for 10 hours while continuously filtering the bath, whereby a 130 μm-thick plating containing 15% by weight of nickel and 85% by weight of cobalt was formed.

(iv) Formation of an alloy plating

The mold body having the nickel-cobalt plating over the base surface was washed with water and was subjected to an electroless plating procedure by being dipped at 85° C. for 7 hours in a bath containing 28 g/l of nickel chloride, 30 g/l of sodium citrate and 3 g/l of sodium borohydride having a pH of 9 to form a 32 μm-thick alloy plating consisting of 97% by weight of nickel and 3% by weight of boron.

(v) Formation of a chromium plating

A 20 μm-thick chromium plating was formed in the similar manner as in Example 1.

The mold was washed with water and dried. Then the coating composition was removed from the masked area, giving the mold of this invention.

Six other molds were treated in the same manner as above.

The molds were used to continuously cast low-carbon steels at a casting rate of 1.0 m/min.

Table 6 below shows the results.

TABLE 6

| No. | Surface roughness | Appearance of topcoat after 100 charges* Crack | Separation | Mold life (number of charges) | Appearance of slab surface (after 100 charges) |
|---|---|---|---|---|---|
| 1 | Less than 10S | A | None | 350 | Normal |
| 2 | 20S | A | None | 400 | Good |
| 3 | 50S | None | None | 600 | Good |
| 4 | 100S | None | None | 800 | Excellent |
| 5 | 150S | None | None | 800 | Excellent |
| 6 | 200S | B | None | 700 | Good |
| 7 | 250S | B | None | 500 | Good |

*Amount of molten steel per charge = 250 t

EXAMPLE 6

(i) Formation of a rough surface

A copper mold similar to that of Example 3 was machined by a shaper to provide an uneven base surface.

As apparent from Table 6, the molds used in this example were found outstanding in the durability and gave steel slabs with improved quality. The amounts of vitreous powder used were reduced by 20 to 30% on an average.

EXAMPLE 7

(i) Formation of a rough surface

A copper mold (400 mm wide×1500 mm long×700 mm high) for continuously casting steel slabs was machined in the same manner as in Example 3 to provide an uneven base surface.

(ii) Pretreatment

The similar procedure as in Example 3 was repeated.

(iii) Formation of a nickel plating

After the activation, the mold body was washed with water and was electroplated by being immersed in a bath containing 450 g/l of nickel sulfamate and 25 g/l of boric acid and having a temperature of 55° C. and a pH of 3.1 at a cathode current density of 2 A/dm$^2$ for 26 hours to form a 500 μm-thick nickel plating.

(iv) Formation of an alloy plating

The mold body having the nickel plating formed over the rough surface was washed with water and was subjected to an electroless plating procedure by being dipped in a bath containing 20 g/l of nickel sulfate, 10 g/l of cobalt chloride, 60 g/l of sodium citrate and 20 g/l of sodium hypophosphite and having a temperature of 85° C. and a pH of 4.8 for 20 hours to form a 67 μm-thick alloy plating containing 62% by weight of nickel, 26% by weight of cobalt and 12% by weight of phosphorus.

(v) Formation of a chromium plating

A 25 μm-thick chromium plating was formed in the similar manner as in Example 3.

The mold body was washed with water and dried. The coating composition was removed from the masked area, giving the mold of this invention.

Six other molds were treated in the similar manner as above.

These molds were used to continuously cast high-carbon steels at a casting rate of 1.5 m/min.

Table 7 shows the durability of the molds and the appearance of surface of slabs.

TABLE 7

| No. | Surface roughness | Appearance of topcoat after 100 charges* Crack | Separation | Mold life (number of charges) | Appearance of slab surface (after 100 charges) |
|---|---|---|---|---|---|
| 1 | Less than 10S | B | Found along minute cracks | 250 | Normal |
| 2 | 20S | A | None | 350 | Normal |
| 3 | 50S | A | None | 550 | Good |
| 4 | 100S | None | None | 800 | Excellent |
| 5 | 150S | None | None | 800 | Excellent |
| 6 | 200S | None | None | 750 | Excellent |
| 7 | 250S | B | None | 550 | Good |

*Amount of molten steel per charge = 250 t

The molds used in this example produced remarkable results as indicated in Table 7. The amounts of the vitreous powder were decreased by 20 to 30% compared with those involved in conventional molds.

EXAMPLE 8

A copper mold dimensionally identical with the mold used in Example 7 was machined by a shaper over the portion of the base surface to be brought in contact with molten steel to give a surface roughness of 70S so that the ridges and valleys of the irregular surface extend in the direction of flow of molten steel. Nine other molds were treated in the same manner as above to give a similar surface roughness. There were formed first layers over the base surfaces and second layers over the first layers, each layer having the compositions and thicknesses as shown in Table 8. Over each second layer was applied a 10 μm-thick chromium layer.

These molds were used to continuously cast high-carbon steels in the same manner as in Example 7. Table 8 below shows the results.

TABLE 8

| No. | First layer Composition (wt. %) Ni | Co | Thickness (μm) | Second layer Composition (wt. %) Ni | Co | P | B | Thickness (μm) | Mold life (number of charges) | Appearance of slab surface (after 200 charges) |
|---|---|---|---|---|---|---|---|---|---|---|
| 1 | 95 | 5 | 500 | 95 | 4 | — | 1 | 30 | 800 | Excellent |
| 2 | 95 | 5 | 500 | 89 | 3 | 8 | — | 30 | 800 | Excellent |
| 3 | 95 | 5 | 200 | 91 | 4 | — | 5 | 30 | 700 | Good |
| 4 | 70 | 30 | 500 | 62 | 27 | 11 | — | 30 | 500 | Normal |
| 5 | 70 | 30 | 500 | 85 | 4 | 11 | — | 30 | 600 | Good |
| 6 | 80 | 20 | 500 | 91 | 4 | — | 5 | 30 | 800 | Excellent |
| 7 | 95 | 5 | 1000 | 86 | 3 | 11 | — | 30 | 700 | Good |
| 8 | 95 | 5 | 1000 | 90 | 4 | 6 | — | 30 | 800 | Excellent |
| 9 | 95 | 5 | 2000 | 90 | 4 | 6 | — | 60 | 800 | Good |
| 10 | 60 | 40 | 300 | 53 | 35 | 10 | 2 | 30 | 500 | Normal |

EXAMPLE 9

(i) Formation of a rough surface

A mold made of copper alloy containing 1% by weight of silver (280 mm wide×1000 mm long×700 mm high) was machined in the same manner as in Example 3 to provide an uneven surface.

(ii) Pretreatment

The same procedure as in Example 3 was repeated.

(iii) Formation of a nickel plating

After the activation, the mold body was washed with water and was electroplated by being immersed at 55°

C. for 11 hours in a bath containing 450 g/l of nickel sulfamate and 25 g/l of boric acid having a pH of 3.1 at a cathode current density of 2 A/dm$^2$ to form a 200 μm-thick nickel plating.

(iv) Formation of an alloy plating

The mold body electroplated above was washed with water and was submerged in an electroless plating bath containing 40 g/l of cobalt chloride, 15 cc/l of ethylenediamine, 10 g/l of sodium citrate, 15 g/l of sodium hypophosphite and 3 g/l of sodium borohydride and having a temperature of 80° C. and a pH of 12.0 for 10 hours to form a 37 μm-thick alloy plating consisting of 86% by weight of cobalt, 9% by weight of phosphorus and 5% by weight of boron. Then electrolysis was continued for 10 minutes at room temperature and an anode current density of 20 A/dm$^2$ by passing current through an aqueous solution containing 100 g/l of sodium hydroxide to form about 0.1 μm-thick oxidized layer.

Then the mold body was washed with water and dried. The coating composition was removed from the masked area. The outer surface of the mold was cooled with water while the inner surface of the mold was uniformly heated for about 40 minutes by oxy-propane burner flame. Six other molds were treated in the same manner as above. The molds were used to continuously casting medium-carbon steels at a casting rate 1.2 m/min. Table 9 below indicates the durability of the test molds and the appearance of surface of slabs.

TABLE 9

| No. | Surface roughness | Appearance of topcoat after 100 charges* Crack | Separation | Mold life (number of charges) | Appearance of slab surface (after 100 charges) |
|---|---|---|---|---|---|
| 1 | Less than 10S | A | None | 250 | Normal |
| 2 | 20S | A | None | 350 | Normal |
| 3 | 50S | None | None | 600 | Good |
| 4 | 100S | None | None | 750 | Excellent |
| 5 | 150S | None | None | 800 | Excellent |
| 6 | 200S | None | None | 750 | Good |
| 7 | 250S | B | None | 600 | Normal |

*Amount of molten steel per charge = 250 t

EXAMPLE 10

(i) Formation of a rough surface

A copper mold (320 mm wide×1500 mm long×700 mm high) for continuously casting steel slabs was machined in the same manner as in Example 3 to provide an uneven surface.

(ii) Pretreatment

The same procedure as in Example 3 was repeated.

(iii) Formation of a nickel plating

After the activation, the mold body was washed with water and was electroplated by being immersed in a bath containing 320 g/l of nickel sulfate, 30 g/l of nickel chloride, 10 g/l of boric acid and 3 g/l of sodium naphthalene trisulfonate and having a temperature of 55° C. and a pH of 4.5 at a cathode current density of 2 A/dm$^2$ while continuously filtering the bath, whereby a 210 μm-thick nickel plating was formed.

(iv) Formation of an alloy plating

The mold thus plated was washed with water and was subjected to an electroless plating procedure by being dipped at 72° C. and for 9 hours in a bath containing 30 g/l of nickel chloride, 15 g/l of cobalt sulfate, 10 g/l of sodium hypophosphite, 5 g/l of sodium borohydride and 65 g/l of sodium citrate having a pH of 10, whereby over the first layer was formed a 23 μm-thick alloy plating consisting of 84% by weight of nickel, 11% by weight of cobalt, 3% by weight of phosphorus and 2% by weight of boron. Then an oxidized layer was applied over the alloy plating in the same manner as in Example 9.

The mold was washed with water and dried. The coating composition was removed from the masked area.

Six other molds were similarly treated.

These molds were tested for the properties and durability and appearance of the slab surface by continuously casting high-carbon steels at a casting rate of 1.2 m/min. Table 10 shows the results.

TABLE 10

| No. | Surface roughness | Appearance of topcoat after 100 charges* Crack | Separation | Mold life (number of charges) | Appearance of slab surface (after 100 charges) |
|---|---|---|---|---|---|
| 1 | Less than 10S | A | None | 400 | Normal |
| 2 | 20S | A | None | 500 | Good |
| 3 | 50S | A | None | 550 | Good |
| 4 | 100S | None | None | 750 | Excellent |
| 5 | 150S | None | None | 800 | Excellent |
| 6 | 200S | None | None | 750 | Good |
| 7 | 250S | B | None | 600 | Normal |

*Amount of molten steel per charge = 250 t

EXAMPLE 11

Eight molds similar to those used in Example 10 were machined and pretreated in the same manner as therein. There were formed over the base surfaces first layers and then second layers having the compositions and thicknesses as listed in Table 11. Over each second layer was forced an oxidized layer about 0.1 μm thick by electrolysis.

These molds were used for continuously casting high-carbon steels in the same manner as in Example 10. Table 11 below indicates the results.

TABLE 11

| No. | First layer Composition (wt. %) Ni | Co | Thickness (μm) | Second layer Composition (wt. %) Ni | Co | P | B | Thickness (μm) | Mold life (number of charges) | Appearance of slab surface (after 200 charges) |
|---|---|---|---|---|---|---|---|---|---|---|
| 1 | 100 | — | 200 | 85 | 4 | 11 | — | 30 | 750 | Excellent |
| 2 | 100 | — | 300 | 95 | 4 | — | 1 | 30 | 800 | Excellent |
| 3 | 100 | — | 500 | 91 | 4 | — | 5 | 30 | 750 | Good |
| 4 | 100 | — | 1000 | 62 | 27 | 11 | — | 30 | 700 | Normal |
| 5 | 70 | 30 | 500 | 62 | 27 | 8 | 3 | 30 | 550 | Normal |
| 6 | 70 | 30 | 500 | 62 | 27 | 10 | 1 | 60 | 500 | Normal |
| 7 | 70 | 30 | 300 | 53 | 35 | 10 | 2 | 30 | 450 | Normal |
| 8 | 60 | 40 | 300 | 53 | 35 | 10 | 2 | 60 | 400 | Normal |

We claim:

1. A mold of copper or copper alloy for continuously casting steel made by the method comprising providing a roughened initial surface of a copper or copper alloy mold, plating a first coating of nickel, cobalt or alloy thereof over the roughened initial surface thereof, plating a second coating of chromium over the first coating, whereby a mold is formed having a rough inner surface corresponding to the roughness of said initial surface.

2. The mold as defined in claim 1 in which the inner surface has a surface roughness of about 20 to about 200S.

3. The mold as defined in claim 2 in which the inner surface has a surface roughness of about 50 to about 150S.

4. The mold as defined in claim 1 in which the plating of nickel, cobalt or alloy thereof is about 195 to about 2950 μm thick and the chromium plating is about 5 to about 100 μm thick.

5. The mold as defined in claim 1 in which the plating of nickel, cobalt or alloy thereof is about 300 to about 1000 μm thick and the chromium plating is about 10 to about 30 μm thick.

6. A mold of copper or copper alloy for continuously casting steel made by the method comprising providing a roughened initial surface of a copper or copper alloy mold, plating a first coating of nickel, cobalt or alloy thereof over the roughened initial surface, and plating a second coating of an alloy selected from the group consisting of alloys of (a) 3 to 20% by weight phosphorous and, as the balance, nickel, (b) 3 to 20% by weight phosphorous and, as the balance, cobalt, (c) 3 to 20% by weight phosphorous and, as the balance, nickel and cobalt, (d) 2 to 15% by weight boron and, as the balance, nickel, (e) 2 to 15% by weight boron and, as the balance, cobalt, (f) 2 to 15% by weight boron and, as the balance, nickel and cobalt, (g) 3 to 20% by weight phosphorous, 2 to 15% by weight boron and, as the balance, nickel, (h) 3 to 20% by weight phosphorous, 2 to 15% by weight boron and, as the balance, cobalt, and (i) 3 to 20% by weight phosphorous, 2 to 15% by weight boron and, as the balance, nickel and cobalt, over the first coating, whereby a mold is formed having a rough inner surface corresponding to the roughness of said initial surface.

7. The mold as defined in claim 6 in which the inner surface has a surface roughness of about 20 to about 200S.

8. The mold as defined in claim 7 in which the inner surface has a surface roughness of about 50 to about 150S.

9. The mold as defined in claim 6 in which the first coating has a thickness of about 30 to about 1900 μm and the second coating has a thickness of about 10 to about 100 μm.

10. The mold as defined in claim 9 in which the first coating is about 200 to about 1000 μm thick and the second coating is about 20 to about 60 μm thick.

11. A mold of copper or copper alloy for continuously casting steel made by the method comprising providing a roughened initial surface of a copper or copper alloy mold, plating a first coating of nickel, cobalt or alloy thereof over the roughened initial surface, plating a second coating of an alloy selected from the group consisting of alloys of (a) 3 to 20% by weight phosphorous and, as the balance, nickel, (b) 3 to 20% by weight phosphorous and, as the balance, cobalt, (c) 3 to 20% by weight phosphorous and, as the balance, nickel and cobalt, (d) 2 to 15% by weight boron and, as the balance, nickel, (e) 2 to 15% by weight boron and, as the balance, cobalt, (f) 2 to 15% by weight boron and, as the balance, nickel and cobalt, (g) 3 to 20% by weight phosphorous, 2 to 15% by weight boron and, as the balance, nickel, (h) 3 to 20% by weight phosphorous, 2 to 15% by weight boron and, as the balance, cobalt, and (i) 3 to 20% by weight phosphorous, 2 to 15% by weight boron and, as the balance, nickel and cobalt, over the first coating, and plating a third coating of chromium over the second coating, whereby a mold is formed having a rough inner surface corresponding to the roughness of said initial surface.

12. The mold as defined in claim 11 in which the inner surface has a surface roughness of about 20 to about 200S.

13. The mold as defined in claim 12 in which the inner surface has a surface roughness of about 50 to about 150S.

14. A mold as defined in claim 11 in which the first coating is about 30 to about 1900 μm thick, the second coating is about 10 to about 100 μm thick, and the third coating is about 5 to 100 μm thick.

15. The mold as defined in claim 14 in which the first coating is about 200 to about 1000 μm thick, the second coating is about 20 to about 60 μm thick, and the third coating is about 10 to about 30 μm thick.

16. A mold of copper or copper alloy for continuously casting steel made by the method comprising providing a roughened initial surface of a copper or copper alloy mold, plating a first coating of nickel, cobalt or alloy thereof over the roughened initial surface, plating a second coating of an alloy selected from the group consisting of alloys of (a) 3 to 20% by weight phosphorous and, as the balance, nickel, (b) 3 to 20% by weight phosphorous and, as the balance, cobalt, (c) 3 to 20% by weight phosphorous and, as the balance, nickel and cobalt, (d) 2 to 15% by weight boron and, as the balance, nickel, (e) 2 to 15% by weight boron and, as the balance, cobalt, (f) 2 to 15% by weight boron and, as the balance, nickel and cobalt, (g) 3 to 20% by weight phosphorous, 2 to 15% by weight boron and, as the balance, nickel, (h) 3 to 20% by weight phosphorous, 2 to 15% by weight boron and, as the balance, cobalt, and (i) 3 to 20% by weight phosphorous, 2 to 15% by weight boron and, as the balance, nickel and cobalt, over the first coating, and oxidizing an uppermost layer of the second coating to form an oxidized layer, whereby a mold is formed having a rough inner surface corresponding to the roughness of said initial surface.

17. The mold as defined in claim 16 in which the inner surface has a surface roughness of about 20 to about 200S.

18. The mold as defined in claim 17 in which the inner surface has a surface roughness of about 50 to about 150S.

19. The mold as defined in claim 16 in which the first coating is about 30 to about 1900 μm thick, the second coating is about 10 to about 100 μm thick, and the oxidized layer is about 0.001 to about 0.5 μm thick.

20. The mold as defined in claim 19 in which the first coating is about 200 to about 1000 μm thick, the second coating is about 20 to about 60 μm thick, and the oxidized layer is about 0.001 to about 0.5 μm thick.

* * * * *

UNITED STATES PATENT AND TRADEMARK OFFICE

CERTIFICATE OF CORRECTION

PATENT NO. : 4,538,667

DATED : September 3, 1985

INVENTOR(S) : SENRI HARA ET AL

It is certified that error appears in the above-identified patent and that said Letters Patent is hereby corrected as shown below:

On the cover page, Item [63], change "Apr. 27, 1984," to --- Apr. 27, 1982, ---.

Signed and Sealed this

*Eleventh* Day of *March 1986*

[SEAL]

*Attest:*

DONALD J. QUIGG

*Attesting Officer*

*Commissioner of Patents and Trademarks*